US011424523B2

(12) United States Patent
Epple et al.

(10) Patent No.: US 11,424,523 B2
(45) Date of Patent: Aug. 23, 2022

(54) RESONATOR WITH TEMPERATURE COMPENSATION

(71) Applicant: Tesat-Spacecom GmbH & Co. KG, Backnang (DE)

(72) Inventors: Dennis Epple, Backnang (DE); Michael Franz, Backnang (DE); Jean Parlebas, Backnang (DE); Ruben Bühler, Backnang (DE)

(73) Assignee: Tesat-Spacecom GmbH & Co. KG

( * ) Notice: Subject to any disclaimer, the term of this patent is extended or adjusted under 35 U.S.C. 154(b) by 40 days.

(21) Appl. No.: 16/800,065

(22) Filed: Feb. 25, 2020

(65) Prior Publication Data

US 2020/0287261 A1 Sep. 10, 2020

(30) Foreign Application Priority Data

Mar. 8, 2019 (DE) ..... 10 2019 105 941.0

(51) Int. Cl.

| | |
|---|---|
| ***H01P 7/10*** | (2006.01) |
| ***H01P 1/30*** | (2006.01) |
| ***H01P 3/16*** | (2006.01) |
| ***H01P 1/20*** | (2006.01) |

(52) U.S. Cl.

CPC ..... *H01P 1/30* (2013.01); *H01P 1/2002* (2013.01); *H01P 3/16* (2013.01); *H01P 7/10* (2013.01)

(58) Field of Classification Search

CPC ..... H01P 1/2084; H01P 1/2086; H01P 1/207; H01P 1/208; H01P 1/201; H01P 1/20; H01P 1/2002; H01P 1/30; H01P 7/10; H01P 7/105; H01P 7/06

See application file for complete search history.

(56) References Cited

U.S. PATENT DOCUMENTS

| | | | | |
|---|---|---|---|---|
| 5,909,160 | A | 6/1999 | Dick et al. | |
| 6,362,708 | B1 * | 3/2002 | Woods | H01P 1/20309 333/219.1 |
| 2014/0111289 | A1 | 4/2014 | Arnold et al. | |
| 2017/0279180 | A1 * | 9/2017 | Park | H01P 7/06 |
| 2017/0294280 | A1 * | 10/2017 | Sewiolo | H01H 33/666 |
| 2017/0317662 | A1 | 11/2017 | Kaesser | |

FOREIGN PATENT DOCUMENTS

| | | | | |
|---|---|---|---|---|
| DE | 102012020576 | A1 | 4/2014 | |
| DE | 102016107955 | A1 | 11/2017 | |
| EP | 492304 | A1 | 7/1992 | |
| EP | 3240102 | A1 | 11/2017 | |
| JP | 2001085908 | A * | 3/2001 | H01P 1/202 |

* cited by examiner

*Primary Examiner* — Stephen E. Jones
(74) *Attorney, Agent, or Firm* — Lerner, David, Littenberg, Krumholz & Mentlik, LLP

(57) ABSTRACT

A resonator for a filter includes a resonator housing, in which a resonator space is formed. The resonator further includes a dielectric arrangement arranged in the resonator space including a first dielectric element and a second dielectric element, the first dielectric element and the second dielectric element being separated from one another in such a way that a gap is formed between them. Both a first thermal expansion coefficient of the first dielectric element and a second thermal expansion coefficient of the second dielectric element are less than a thermal expansion coefficient of the resonator housing. A temperature-related variation of the resonant frequency of the resonator can therefore be compensated for.

13 Claims, 4 Drawing Sheets

RESONATOR WITH TEMPERATURE COMPENSATION

FIELD OF THE INVENTION

The present invention relates to a resonator, in particular a radiofrequency resonator, and to a filter which comprises such a resonator. The resonator is designed in order to compensate at least partially for a temperature-related variation of the resonant frequency. The filter may, for example, be integrated in an output multiplexer (OMUX) or an input multiplexer (IMUX).

BACKGROUND OF THE INVENTION

Resonators may, for example, be used as components for frequency filters. In a filter, a plurality of such resonators are typically coupled to one another in order to transmit or pass signals in a desired frequency band. A resonator conventionally comprises a housing, which at least partially encloses a hollow space (which may also be referred to as a cavity or resonance space). Apertures, which are configured as openings in the housing wall, may be arranged in the housing in order to excite the desired modes in the hollow space when a signal is coupled in.

DE 10 2012 020 576 A1 describes the basic structure of a resonator and in addition a possibility for adjusting the bandwidth.

In particular, the transmission properties of a resonator (in particular the resonant frequency and bandwidth) depend on its dimensions and shape and in general on the geometrical configuration. As a further possibility for influencing the transmission properties of a resonator, a dielectric may be arranged in the hollow space of the resonator.

A dielectric in a resonator is described in DE 10 2016 107 955 A1 and EP 3 240 102 A1, a liquid crystal functioning as the dielectric in this case. The dielectric is used in order to set a resonant frequency or central frequency of the resonator. In order to adapt the permittivity of the liquid crystal, an electrical control field is used.

Resonators are coupled to one another so as to be used as filters. The filters are, for example, used as parts of communication systems in satellites. If such resonators are used in satellites, the resonators are sometimes subjected to large temperature variations of 100 K or even more in space. Temperature variations influence the resonant frequency of a resonator, in particular because the components used expand or contract according to their thermal expansion coefficient. These variations influence the transmission properties of a resonator and often constitute undesired variations.

BRIEF SUMMARY OF THE INVENTION

An aspect of the present invention may provide a simplified possibility for temperature compensation of a resonator.

In particular, provision is made for the temperature compensation to be carried out passively and without the need for active control. To this end, dielectric elements are arranged in the cavity of a resonator, which ensure that a temperature-related variation of the resonant frequency due to thermally induced expansion or contraction of the resonator is compensated for.

According to one aspect, a resonator for a filter is provided. The resonator comprises a resonator housing, in which a resonator space is formed, and a dielectric arrangement arranged in the resonator space consisting of a first dielectric element and a second dielectric element. The first dielectric element and the second dielectric element are separated from one another in such a way that a gap is formed between them, both a first thermal expansion coefficient of the first dielectric element and a second thermal expansion coefficient of the second dielectric element being less than a thermal expansion coefficient of the resonator housing.

The resonator may, for example, be a radiofrequency resonator for use in a satellite. The resonant frequency of a resonator depends, in particular, on the configuration of the resonator. Correspondingly, a resonator can be adapted to the respective requirements. For example, a resonant frequency of 3.4 GHz may be achieved by a particular geometry of the resonator. The same resonant frequency may also be achieved, when a resonator has a smaller resonator space, if a dielectric is arranged in the resonator space. Particularly for satellites, this has the advantage that the installation space required is smaller when a dielectric is arranged in the resonator space in order to adjust the resonant frequency to the desired value.

In satellites which are in an Earth orbit, the temperature can vary very greatly. If the satellite is exposed to direct solar radiation, the satellite and its components are heated strongly. If the satellite is in the shadow of the Earth, on the other hand, the temperature falls to very low values. Variations of the temperature also influence the resonant frequency and therefore the transmission properties of a resonator, which in general is undesired. Usually, a rising temperature leads to a thermal expansion. In a resonator, this also leads to the volume of the resonator space increasing. Typically, the resonant frequency varies in such a way that it becomes smaller with a rising temperature and an increasing volume of the resonator space.

This behaviour is in the present case remedied, or compensated for, by two dielectric elements being arranged opposite one another and with a gap between them, and furthermore by the thermal expansion coefficients of the dielectric elements being less than the thermal expansion coefficient of the resonator housing.

If the temperature rises, the resonator expands, and the volume of the resonator space increases. With a falling temperature, the opposite naturally applies. The dielectric elements arranged in the resonator space likewise expand or contract, but by a smaller amount than the resonator space. Furthermore, the distance between the two dielectric elements varies, i.e. the width of the gap varies. With a rising temperature, the distance between the dielectric elements increases, and with a falling temperature the distance between the dielectric elements decreases. The thermal expansion of the dielectric elements and the variation of the dimensions of the gap between the dielectric elements as a result of the thermal expansion of the dielectric elements compensate for the variation of the resonant frequency as a result of the thermal expansion of the resonator housing.

The two dielectric elements have the function of concentrating electrical field lines inside the resonator housing and of thereby influencing the transmission properties of the resonator. The dielectric elements are arranged in the resonator space as a function of which mode is intended to be excited in the resonator. In principle, this function is also fulfilled by a single dielectric element. In the present case and for the purposes described here, the function of the dielectric element is fulfilled by a pair of dielectric elements. The gap between the two dielectric elements has an influence on the radiofrequency properties of these two dielectric elements. Because the gap is arranged between the dielectric elements, the resonant frequency of the resonator can be kept at the same value, or at substantially the same value, despite variation of the temperature and different absolute thermally induced expansion of the resonator housing and dielectric elements.

According to one embodiment the first thermal expansion coefficient and the second thermal expansion coefficient are of equal value.

This means that the mutually opposing end sides of the dielectric elements move towards one another or away from one another respectively by the same amount in the event of a variation of the temperature. In particular, the dielectric elements are made from the same material.

In one alternative embodiment, the thermal expansion coefficients of the dielectric elements may also be different.

According to another embodiment, the first dielectric element and the second dielectric element have an identical cross section.

This may have the property that the field lines are concentrated inside the resonator space and/or are transmitted from the first dielectric element to the second dielectric element through the gap with a better effect. In particular, the end surfaces of the two dielectric elements have an identical size and shape. An end surface may, in particular, be regarded as that surface of a dielectric element which as a continuous surface is closest to the other dielectric element.

In one alternative embodiment, the cross sections of the dielectric elements are different.

According to another embodiment, the first dielectric element and the second dielectric element are arranged opposite one another.

The dielectric elements may, for example, be configured as cuboids. In this case, the cuboids are, in particular, arranged in the resonator space in such a way that they are opposite one another in the longitudinal direction of the two cuboids. For example, the longitudinal axes of the two cuboids coincide. The longitudinal direction and the longitudinal axis of a cuboid are defined by those edges of the cuboid which are longest in comparison with the other edges. For example, the field lines in the resonator space likewise extend through the two dielectric elements in the longitudinal direction of the cuboids. The field lines of the field in the resonator space extend in the same direction through the gap between the dielectric elements.

The two dielectric elements are arranged in such a way that they are coupled to one another in a radiofrequency system, which in particular results from the fact that the electrical field lines inside the resonator space extend through the gap between the first dielectric element and the second dielectric element.

According to another embodiment, the first dielectric element and the second dielectric element are arranged in such a way that their cross sections overlap without a lateral offset.

If a projection of the dielectric elements from a viewing direction that corresponds to the extent direction of the field lines through the gap is considered, the projections of the two dielectric elements are identical in this embodiment. Considered from the same viewing direction, the dielectric elements are furthermore arranged in such a way that, in relation to this viewing direction, there is no overlap to the left/right and/or up/down between the two dielectric elements.

In particular, the dielectric elements are arranged in such a way that their mutually opposing end sides do not laterally overlap. This may have an advantage for the quality of the coupling between the two dielectric elements.

It is conceivable that the mutually facing ends of the dielectric elements are configured in a step fashion with at least one step. The dielectric elements may then be arranged opposite one another in such a way that the distances between the end surfaces of the individual steps are equal or almost equal. The distances between the individual steps may, however, also be different, which may for example be used in order to adjust the resonant frequency as desired.

According to another embodiment, the resonator housing comprises at least one aperture, which is formed as an opening in a side wall of the resonator housing.

In principle, the aperture may be arranged in any wall of the resonator housing. The aperture is used to feed an electric field into the resonator. The resonator housing may also comprise more than one aperture, for example two apertures. One aperture is used to feed a signal in, whereas the other aperture is used to deliver the output signal or to make it possible to tap the signal.

According to another embodiment, an extent direction of the gap extends from the first dielectric element to the second dielectric element transversely with respect to a connecting line between the two apertures.

The extent direction of the gap corresponds to the aforementioned longitudinal direction of the dielectric elements. The field lines in the resonator space extend transversely with respect to a plane in which an aperture is located.

According to another embodiment, the dielectric arrangement is mechanically coupled to the resonator housing so that a thermal expansion of the resonator housing influences a relative position between the first dielectric element and the second dielectric element and a dimension of the gap.

The dielectric arrangement together with the dielectric elements is connected to the resonator housing. If the resonator housing expands as a result of a temperature variation, this also influences the distance between the dielectric elements. The influence of the modified volume of the resonator space on the resonant frequency is compensated for, or substantially compensated for, by an oppositely directed influence of the modified gap between the dielectric elements.

According to another embodiment, the first dielectric element and the second dielectric element are arranged at mutually opposite positions of an inner surface of the resonator housing.

For example, the first dielectric element may be arranged on a left side surface and the second dielectric element may be arranged on a right side surface of the resonator housing. Depending on the viewing direction, a front side surface and a rear side surface may naturally also be used in order to fix the two dielectric elements. The positions of the dielectric elements and their orientations inside the resonator housing are essentially dependent on the arrangement of the apertures.

According to another embodiment, the first dielectric element and the second dielectric element are each adhesively bonded to the resonator housing on a single one of their side surfaces.

The dielectric elements may be adhesively bonded, or otherwise fastened, on any inner surface of the resonator housing. For example, the dielectric elements may be mechanically connected to the resonator housing by means of a plug-in connection, clamping connection or screw connection.

It may be advantageous for a dielectric element to be adhesively bonded to the inner surface of the resonator housing only pointwise or over an area that is as small as possible. This may reduce a mechanical stress build-up when the resonator housing and the dielectric element adhesively bonded thereto expand or contract to a different extent.

Particularly preferably, the dielectric element is adhesively bonded to the inner surface of the resonator housing only on one of its surfaces. This may also reduce the extent of the mechanical stresses resulting from the different thermal expansion coefficients. For example, a surface, opposite to the gap, of the dielectric element is adhesively bonded to the inner surface of the resonator housing.

According to another embodiment, the first dielectric element and the second dielectric element are indirectly coupled to the resonator housing respectively by means of a holding arm or a support element.

The holding arm may, for example, be mechanically fastened (adhesively bonded, screwed, clamped, etc.) on any surface of the dielectric element. The other end of the holding arm is connected to the resonator housing (adhesively bonded, screwed, clamped, configured integrally, etc.). The holding arm may therefore be configured according to the desired position and orientation of the dielectric element inside the resonator housing.

A holding arm may be advantageous when the dielectric element is fastened by means of the holding arm on a side wall of the resonator housing. A support element or pedestal is suitable when the dielectric element is connected to the bottom surface of the resonator housing or to a top. In each case, both the holding arm and the support element fulfil a comparable function, namely to hold, position and orient the dielectric element inside the resonator housing. If a holding arm or a support element is used, the dielectric element fastened thereon does not directly touch one of the inner surfaces of the resonator housing.

According to another embodiment, the dielectric arrangement comprises a third dielectric element and a fourth dielectric element, which are arranged opposite one another so that there is a distance between them, which forms a gap, an extent direction of the gap between the first dielectric element and the second dielectric element and an extent direction of the gap between the third dielectric element and the fourth dielectric element extending orthogonally with respect to one another.

The third dielectric and the fourth dielectric may be referred to as a second pair of dielectric elements. In one embodiment, this second pair of dielectric elements is arranged with respect to the first pair of dielectric elements (the first and the second dielectric element) in such a way that the four dielectric elements form a cross. It is possible for mutually facing end sides of one pair of dielectric elements to extend into the gap which is formed by the dielectric elements of the other pair. In general, this means that the gap width of the first pair of dielectric elements is independent of the gap width of the second pair of dielectric elements. The dielectric elements of the first pair may differ from the dielectric elements of the second pair, for example in terms of size, cross section and material.

Each pair of dielectric elements is intended to use a particular mode inside the resonator housing. In this case, each pair is constructed according to the same basic principles as described with reference to the first pair. The individual pairs of dielectric elements may in principle be arranged independently of one another inside the resonator housing. The positioning and orientation of the pairs of dielectric elements depends on the modes to be used.

According to another embodiment, the resonator housing comprises aluminium or steel or an alloy based on one of these materials.

In general, the resonator housing is made from such a material as is suitable for use in a satellite outside the Earth's atmosphere and furthermore for the intended application purpose in a filter.

According to another embodiment, the dielectric arrangement comprises aluminium oxide ($Al_2O_3$).

The dielectric element consists at least partly of aluminium oxide. It may contain additional admixtures of other materials. In principle, the dielectric arrangement may comprise any dielectric material. The dielectric materials used for two dielectric elements may be the same or different.

The resonator described here may, in particular, be used for communication systems which operate in the radiofrequency range, for example in the C band (in particular at 3.4-4.8 GHz) and in the Ku band (in particular at 10.7-12.75 GHz). Resonators having resonator spaces that are very large in comparison with other frequency bands are required particularly in these frequency bands. A dielectric is therefore preferably used in order to achieve the required high resonant frequencies. The dielectric reduces the resonant frequency, so that the volume of the resonator space may correspondingly be reduced. In this way, expensive installation space is economised particularly for space applications.

According to another aspect, a filter is provided, in particular a radiofrequency filter for the frequency bands mentioned above. The filter comprises at least two resonators as described herein, the at least two resonators being coupled to one another. For example, the two resonators are coupled to one another in such a way that that they constitute a bandpass filter which transmits signals that lie in the frequency range of the cumulative resonant frequencies of the mutually coupled resonators. The filter may be produced from any desired number of resonators.

For example, the filter may be an IMUX filter or an OMUX filter for a communication system of a communication satellite. The filter may be used in the radiofrequency range, for example in the range of several GHz, or in the frequency bands that are conventional for satellite communication, in particular the frequency bands mentioned above.

DETAILED DESCRIPTION

An exemplary embodiment of the present invention will be described below with reference to the figures. In this case, it should be noted that the elements which are the same or similar in the figures are denoted by the same references. The representations in the figures are schematic and not true to scale.

Figure 1:
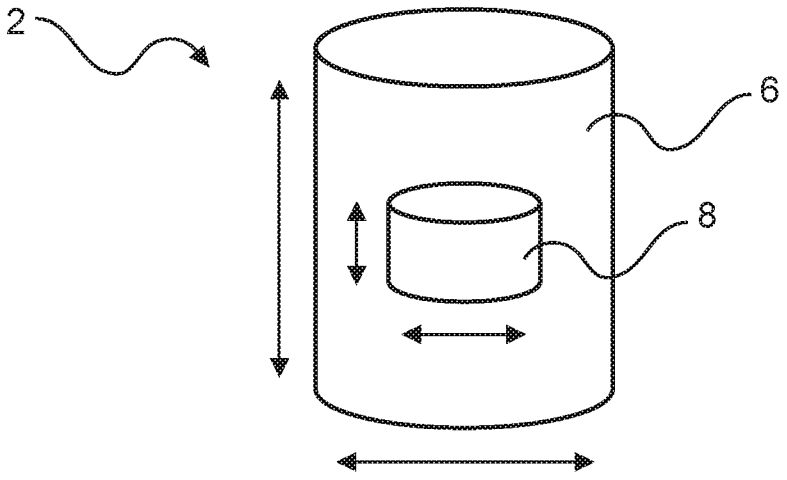
FIG. 1 shows a schematic representation of a resonator space.

FIG. 1 shows for illustration purposes a resonator space 6 of a resonator 2. In the exemplary representation, the interior of the resonator, i.e. the resonator space 6, is shown. The resonator space is cylindrical. That is to say the resonator comprises a cavity or a recess of this shape. It is, of course, also possible for the resonator space to be configured according to other geometrical shapes.

Inter alia, the resonant frequency of the resonator is dependent on the shape and the dimensions of the resonator space 6. A further measure for adapting the resonant frequency is a dielectric element 8, which is arranged inside the resonator space 6.

Figure 2:
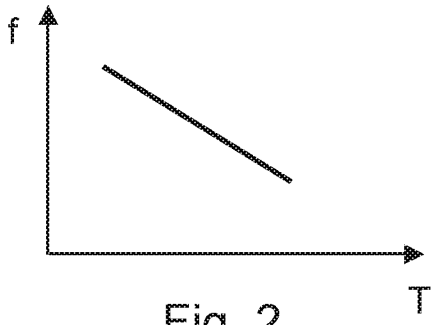
FIG. 2 shows a schematic representation of the resonant frequency of a resonator as a function of temperature.

In principle, the influence of the temperature on the geometry, and therefore on the resonant frequency, of the resonator and of the resonator space 6 is shown with reference to FIG. 1. The general relationship between temperature and resonant frequency is shown in FIG. 2. With a rising temperature (horizontal axis), the volume of the resonator space 6 increases and the resonant frequency (vertical axis) decreases. The expansion or contraction of the resonator is linear, or almost linear, so that the resonant frequency also varies linearly, or almost linearly.

If the temperature of the resonator varies, the resonator and therefore the resonator space 6 expands or contracts which is indicated by the two arrows outside the resonator space 6. Variation of the temperature naturally also leads to the dielectric 8 within the resonator space expanding or contracting. This variation in size is indicated by the arrows that are shown below and to the left of the dielectric 8. However, the thermal expansions or contractions of the resonator and of the dielectric do not always take place to such an extent that the resonant frequency remains the same. Rather, compensation is required therefor.

Figure 3:
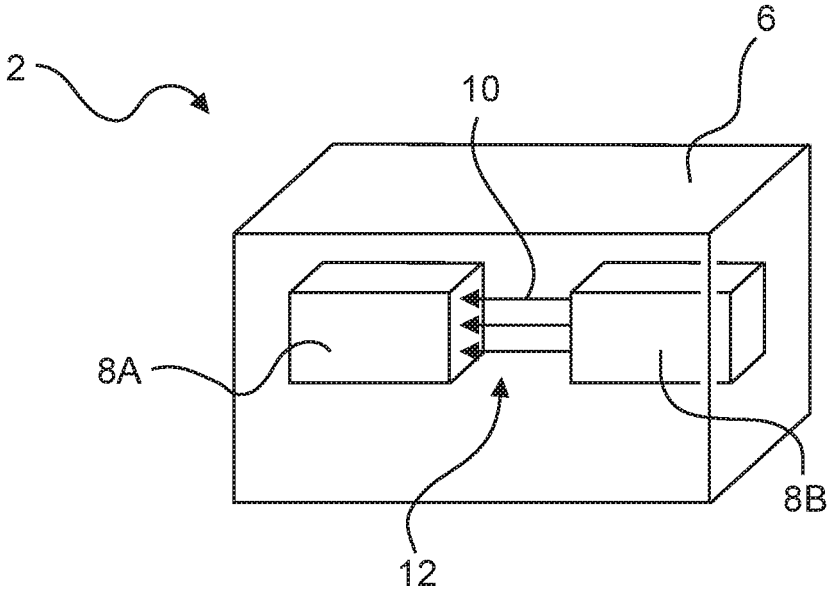
FIG. 3 shows a schematic representation of a resonator according to one exemplary embodiment.

Referring to FIG. 3, a resonator 2 according to one exemplary embodiment is now described. The resonator housing may, for example, comprise a bottom section which is configured integrally with side walls delimiting the resonator space, so that the resonator space is at least partially configured in the shape of a cup. The opening of this structure may be closed by a top, which then forms a part of the resonator housing. The aforementioned elements of the resonator housing may be produced from the same material, for example a metal (in particular aluminium or steel or an alloy based on one or both of these metals). The resonator housing may comprise threaded bores, into which mounting screws for fastening the top can be screwed.

The resonator space comprises an inner wall, which delimits the resonator space at least in sections and extends around the resonator space. The inner wall may be interrupted by aperture openings, or aperture openings can be provided in the inner wall.

A first dielectric element 8A and a second dielectric element 8B are arranged in the resonator space 6 of the resonator 2. In the representation of FIG. 3, the longitudinal direction of the dielectric elements extends from left to right. The first and the second dielectric elements are separated from one another in the longitudinal direction in such a way that a gap 12 is formed between them. With the respective outer surface, i.e. the surface on the opposite side from the gap, each dielectric element is mechanically coupled to the inner wall of the resonator housing. The left surface of the first dielectric element and the right surface of the second dielectric element, for example, are adhesively bonded on the inner wall of the resonator housing.

If a signal is now fed into an aperture (not shown, could be located in the top surface of the resonator in the example of FIG. 3) of the resonator, an electric field is formed in the resonator space 6 and a mode is excited as a function of the signal. The dielectric elements influence the field lines 10. Field lines 10 extend through the gap, for example orthogonally with respect to the end surface of the dielectric elements. FIG. 3 shows a resonator for a single mode. A pair of dielectric elements as shown in FIG. 3 is provided for the excitation of a single mode.

Very generally, the mutually opposing end surfaces of the dielectric elements are preferably parallel to one another.

The thermal expansion coefficients of the resonator housing and of the dielectric elements, as well as the positioning of the dielectric elements inside the resonator space 6, are adapted to one another in such a way that the resonant frequency remains the same in the event of a temperature-related variation of the dimensions of the resonator. Even if the resonator housing expands or contracts, the dielectric elements undergo a corresponding change (albeit to a smaller extent since their thermal expansion coefficient is less than that of the resonator housing). However, the spacing of the dielectric elements at the gap 12 also varies. This distance may become smaller or greater. This variation of the gap 12 compensates for the influence of the temperature-related variation of the dimensions of the resonator housing on the resonant frequency. Other measures for the compensation may therefore be obviated. For example, it is not necessary to use compensating plates or other mechanical compensation devices, electrically controlled compensation devices, or temperature-compensating or self-compensating dielectric elements. Overall, with the resonator described herein the number of elements used and therefore the complexity of a resonator can be reduced.

The combination of the first dielectric element and second dielectric element is referred to in the present case as a dielectric arrangement. The dielectric arrangement is generally distinguished in that there is a gap between the two dielectric elements, which may also be referred to as partial resonators, that is to say the dielectric elements are separated from one another at this position. It has been found that, in such a dielectric arrangement, the size of the gap has an influence on the resonant frequency.

Figure 4:
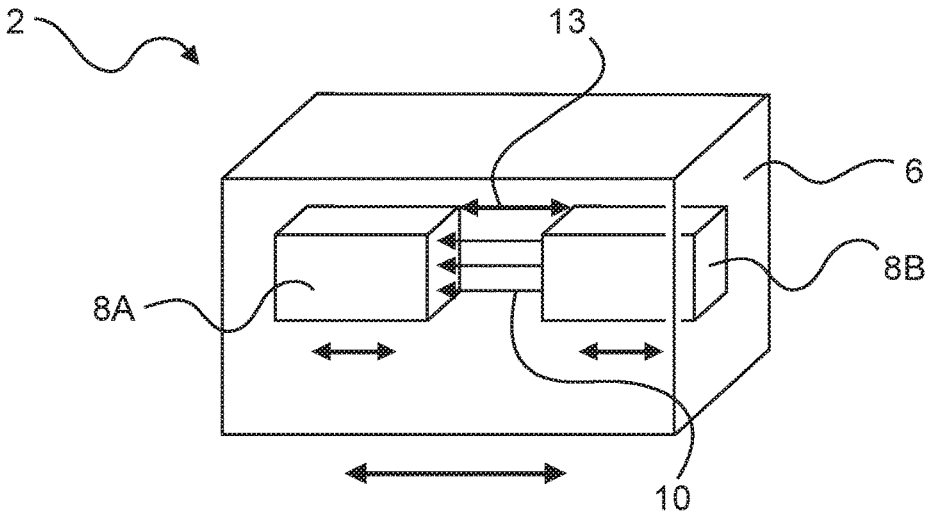
FIG. 4 shows a schematic representation of a resonator according to one exemplary embodiment.

FIG. 4 shows the relationship between the thermally induced length change of the resonator housing, or the resonator space 6, and the change resulting therefrom in the gap width 13 between the first and second dielectric elements 8A and 8B.

The resonator housing has a thermal expansion coefficient which is greater than the thermal expansion coefficients of the first and second dielectric elements 8A and 8B. After the dielectric elements are fastened on the resonator housing, this configuration leads to the gap width 13 increasing when the temperature rises, or conversely the gap width 13 decreasing when the temperature falls.

With a rising temperature, the resonator housing expands, as the arrow outside the resonator space 6 indicates. However, the dielectric elements inside the resonator space also expand, as the arrows below the dielectric elements show.

The extent of the length change of the dielectric elements is, however, less than the extent of the length change of the resonator housing. The distance between the two dielectric elements, the gap width 13, therefore increases. An increasing distance between the two dielectric elements leads to the resonant frequency of the resonator increasing.

Figure 5:
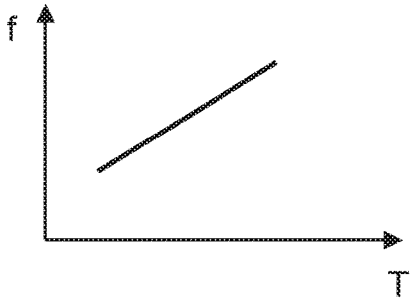
FIG. 5 shows a schematic representation of the resonant frequency of a resonator as a function of the variation of a gap between mutually opposite dielectric elements.

FIG. 5 schematically shows the influence of the gap width on the resonant frequency of the resonator. With a rising temperature (horizontal axis), the resonant frequency increases (vertical axis). This relationship between temperature and resonant frequency is the opposite of the relationship in FIG. 2.

The gap width 13 may take a value of between a few hundredths or tenths of a millimetre to a few millimetres.

Figure 6:
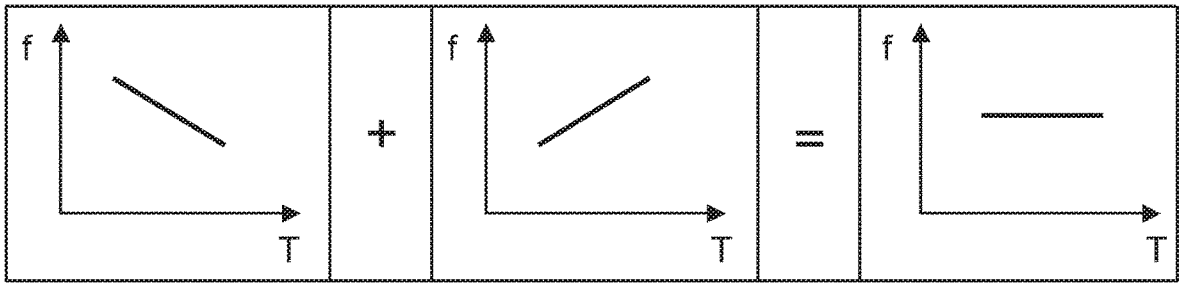
FIG. 6 shows a schematic representation of the effect of the temperature compensation in a resonator according to one exemplary embodiment.

FIG. 6 illustrates the superposition of the influence of temperature changes on the resonator housing and the gap width. The frequency behaviour of a resonator without temperature compensation is shown on the left: with a rising temperature, the resonant frequency decreases (linearly or almost linearly, which corresponds to the representation of FIG. 2). In the middle, the frequency behaviour as a function of temperature is shown for a resonator space which is equipped with a dielectric arrangement as described herein: with a rising temperature, the resonant frequency increases (linearly or almost linearly, which corresponds to the representation of FIG. 5). A combination of these two effects leads to the resonant frequency of the resonator being constant or almost constant at least over a range of temperatures, see FIG. 6, right.

Figure 7:
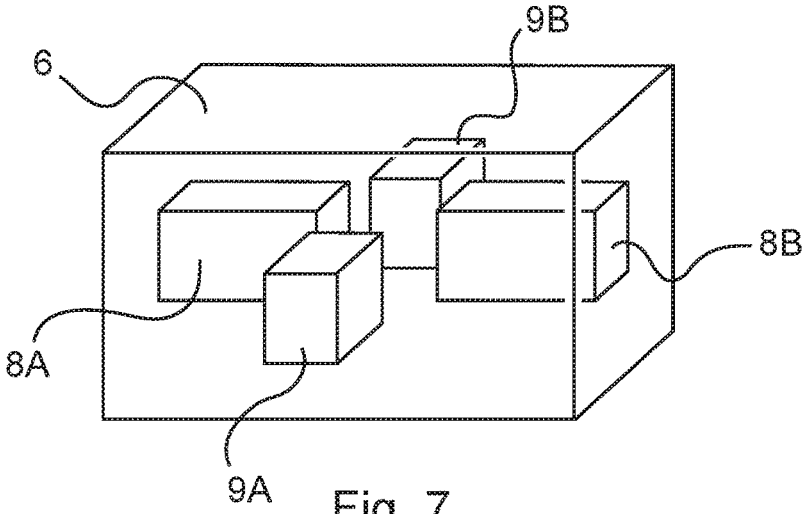
FIG. 7 shows a schematic representation of a resonator according to one exemplary embodiment.

FIG. 7 shows a resonator, in the resonator space 6 of which two pairs of dielectric elements are arranged. The first pair is formed by the dielectric elements 8A and 8B. The second pair is formed by the dielectric elements 9A and 9B. The two pairs lie at about the same height in a plane and extend in this plane at an angle of 90° with respect to one another. The longitudinal direction of the first pair extends from left to right, and the longitudinal direction of the second pair extends from front to back. This structure makes it possible to use 2 modes in the resonator. The respective electric fields of the first and second pairs of dielectric elements extend orthogonally with respect to one another.

Figure 8:
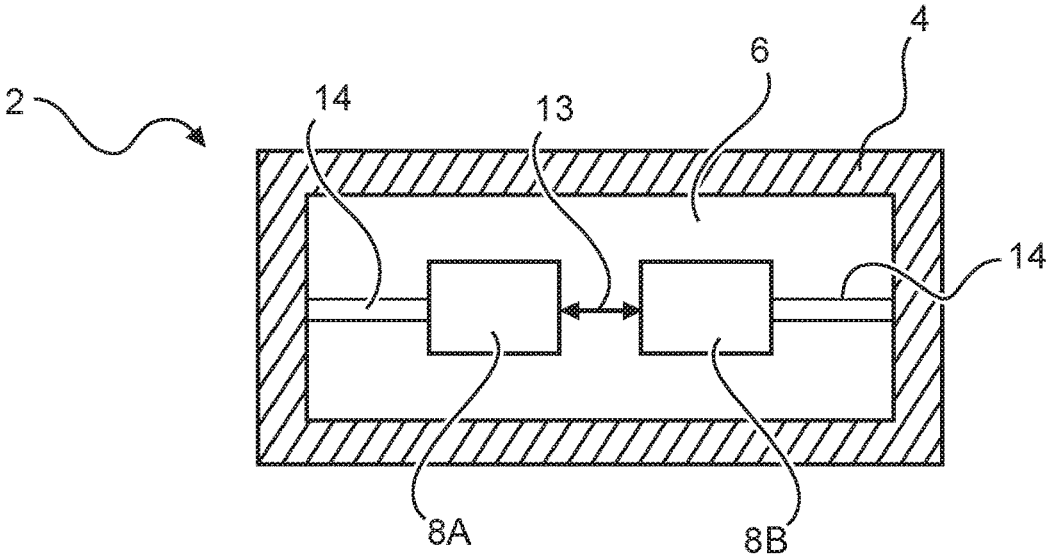
FIG. 8 shows a schematic representation of a plan view of a resonator according to one exemplary embodiment.

FIG. 8 shows a sectional representation in plan view of a resonator as shown in FIG. 3 or FIG. 4, although two holding arms 14 are additionally shown in FIG. 8. The sectional representation is in this case selected in such a way that the resonator is cut approximately horizontally in the middle. The representation is only schematic however, and serves to explain the configuration of the resonator 2.

The resonator 2 shown in FIG. 8 comprises a resonator housing 4 that contains a resonator space 6 in which the resonant frequency is intended to be adjustable. In the exemplary embodiment shown, the resonator space 6 is delimited by a bottom surface, and is furthermore constructed in such a way that the upper end of the resonator space 6 can be closed by a suitable top (not shown).

In the resonator space 6, there are two dielectric elements 8A and 8B, which are separated from one another at a particular distance 13. The dielectric elements are held in the resonator space 6 respectively by a holding arm 14. One end of the holding arm 14 is connected to a side wall of the resonator housing 4. The other end of the holding arm 14 is connected to a dielectric element, for example adhesively bonded to a side surface of the dielectric element. The holding arm may be made from the same material as the resonator housing. The holding arm may be a tubular or rod-shaped metal object (hollow or solid material).

Figure 9:
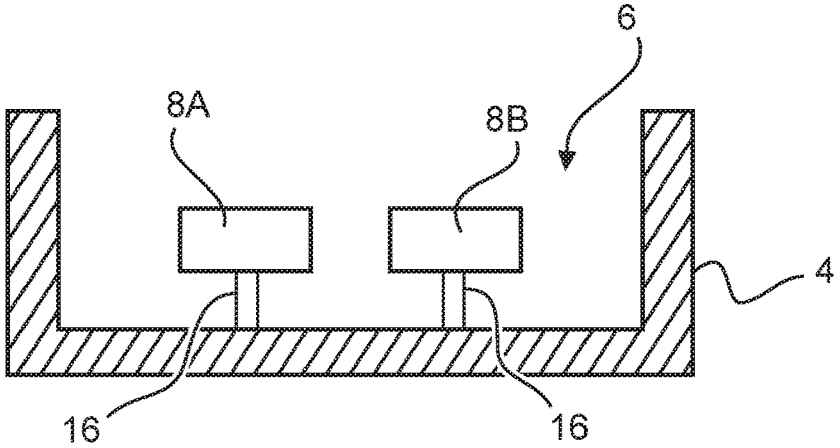
FIG. 9 shows a schematic representation of a side view of a resonator according to one exemplary embodiment.

FIG. 9 shows a lateral sectional representation of the resonator of FIG. 3 and FIG. 4, although two support elements 16 are additionally shown in FIG. 9. The support elements 16 may also be referred to as a pedestal. The dielectric elements 8A, 8B bear on the support element 16. The support element 16 therefore fixes the dielectric elements in relation to a bottom surface of the resonator housing 4.

The support elements may be arranged centrally on the lower side of the dielectric elements. However, the support elements may also be fastened off-centre on the lower side. Preferably, the support elements are offset in the direction of the outer ends (the opposite ends from the gap between the dielectric elements) so that a thermally induced length variation of the dielectric elements has a corresponding effect on the distance between the dielectric elements.

Figure 10:
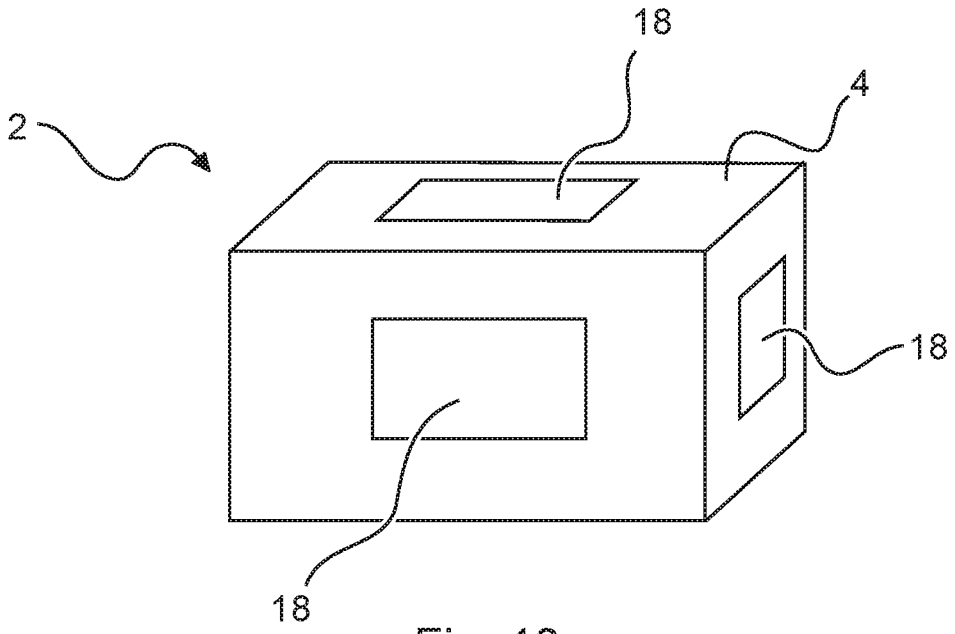
FIG. 10 shows a schematic representation of a resonator according to one exemplary embodiment.

FIG. 10 shows an external view of the resonator 2 with the resonator housing 4. Apertures 18 may be arranged in the side walls of the resonator housing 4. These apertures are used to couple an electrical signal into the resonator or to extract it therefrom. The dielectric arrangement is arranged inside the resonator housing 4 in such a way that an electrical signal coupled in through an aperture 18 excites a mode in the resonator space 6.

In this context, it should be noted that the structure of the resonator housing 4 is not restricted to the structure shown here. Depending on the field of use of the resonator, the resonator housing may be configured with a suitable or desired number of apertures 18 and in a different shape.

Figure 11:
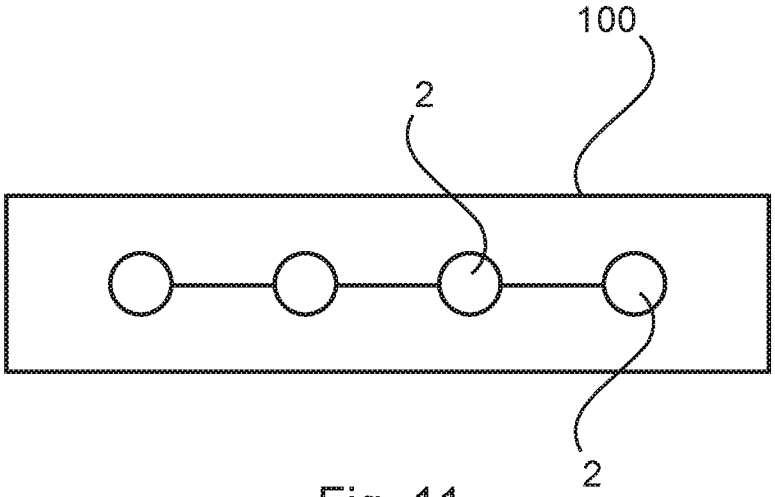
FIG. 11 shows a schematic representation of a filter according to one exemplary embodiment.

FIG. 11 shows a schematic representation of a filter 100. The filter 100 comprises a plurality of resonators 2 connected in series. Each resonator 2 may be adjusted to an individual resonant frequency. Such a filter may be used in a transmission path of a communication satellite.

In addition, it is to be pointed out that "having" or "comprising" does not exclude any other elements or steps, and "a" or "one" does not exclude a multiplicity. Furthermore, it is to be pointed out that features or steps which have been described with reference to one of the exemplary embodiments above may also be used in combination with other features or steps of other exemplary embodiments described above. References in the claims are not to be regarded as restrictive.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCES

2 resonator
4 resonator housing
6 resonator space
8 dielectric
8A first dielectric element

8B second dielectric element
9A third dielectric element
9B fourth dielectric element
10 field lines
12 gap
13 gap width
14 holding arm
16 pedestal, support element
18 aperture
100 filter

The invention claimed is:

1. A resonator for a filter, the resonator comprising:

a resonator housing, in which a resonator space is formed;

a dielectric arrangement arranged in the resonator space including a first dielectric element and a second dielectric element;

wherein the first dielectric element and the second dielectric element are separated from one another in such a way that a first gap is formed between them, and wherein both a first thermal expansion coefficient of the first dielectric element and a second thermal expansion coefficient of the second dielectric element are less than a thermal expansion coefficient of the resonator housing, wherein the resonator housing comprises at least one first aperture formed as an opening in a first side wall of the resonator housing, wherein the resonator housing comprises at least one second aperture formed as an opening in a second side wall of the resonator housing, and wherein an extent direction of the first gap extends from the first dielectric element to the second dielectric element transversely with respect to a connecting line between the first and second apertures.

2. The resonator according to claim 1, wherein the first thermal expansion coefficient and the second thermal expansion coefficient are of equal value.

3. The resonator according to claim 1, wherein the first dielectric element and the second dielectric element have an identical cross section.

4. The resonator according to claim 1, wherein the first dielectric element and the second dielectric element are arranged at mutually opposite positions of an inner surface of the resonator housing.

5. The resonator according to claim 1, wherein the dielectric arrangement comprises a third dielectric element and a fourth dielectric element arranged opposite one another so that there is a distance therebetween, thereby forming a second gap, and wherein an extent direction of the gap between the first dielectric element and the second dielectric element and an extent direction of the gap between the third dielectric element and the fourth dielectric element extend orthogonally with respect to one another.

6. The resonator according to claim 1, wherein the resonator housing comprises aluminium or steel or an alloy based on one of aluminium or steel.

7. The resonator according to claim 1, wherein the dielectric arrangement comprises aluminium oxide ($Al_2O_3$).

8. A filter, comprising at least two resonators, wherein each resonator is a resonator according to claim 1 and wherein the at least two resonators are coupled to one another.

9. The resonator according to claim 1, wherein the first dielectric element and the second dielectric element are arranged opposite one another.

10. The resonator according to claim 9, wherein the first dielectric element and the second dielectric element are arranged in such a way that the cross sections of the first dielectric element and the second dielectric element overlap without a lateral offset.

11. The resonator according to claim 1, wherein the dielectric arrangement is mechanically coupled to the resonator housing so that a thermal expansion of the resonator housing is configured to influence a relative position between the first dielectric element and the second dielectric element and a dimension of the first gap.

12. The resonator according to claim 11, wherein the first dielectric element and the second dielectric element are each adhesively bonded to the resonator housing on a single one of their side surfaces.

13. The resonator according to claim 11, wherein the first dielectric element and the second dielectric element are indirectly coupled to the resonator housing respectively by a holding arm or a support element.

* * * * *